United States Patent [19]

Chen

[11] Patent Number: 4,588,055

[45] Date of Patent: May 13, 1986

[54] DEVICE FOR TOWING LUGGAGE

[76] Inventor: Tzu L. Chen, No. 26-2, Lane 96, Hsin Lung Rd., Section 2, Taipei, Taiwan

[21] Appl. No.: 713,606

[22] Filed: Mar. 19, 1985

[51] Int. Cl.[4] ..... A45C 5/14; A45C 13/38

[52] U.S. Cl. ..... 190/18 A; 190/115; 280/37; 280/43.17; 280/47.26

[58] Field of Search ..... 190/18 R, 18 A, 115; 280/37, 43.17, 655, 47.26

[56] References Cited

U.S. PATENT DOCUMENTS

| | | | |
|---|---|---|---|
| 3,917,038 | 11/1975 | Foge et al. | 190/18 A |
| 3,960,252 | 6/1976 | Cassimally | 190/18 A |
| 4,087,102 | 5/1978 | Sprague | 190/18 A X |
| 4,254,850 | 3/1981 | Knowles | 190/18 A |

FOREIGN PATENT DOCUMENTS

| | | | |
|---|---|---|---|
| 354482 | 6/1922 | Fed. Rep. of Germany | 280/37 |
| 1593494 | 7/1981 | United Kingdom | 280/655 |

*Primary Examiner*—William Price
*Assistant Examiner*—Sue A. Weaver
*Attorney, Agent, or Firm*—Birch, Stewart, Kolasch & Birch

[57] ABSTRACT

A device for towing luggage incorporated into a wall of the luggage comprising a pair of fixed tubes, a pair of push-pull tubes and a U-shaped tube wherein each end of the U-shaped tubes is connected to the push-pull tubes. A pair of levers one end of each being overlapped and hinged on the middle of the U-shaped tube and a pair of reversed L-shaped links which are fulcrumed at their angled parts and are hinged on the other ends of the levers. By pushing down and pulling up the handle, the wheel units can be extended outward or retracted inward.

2 Claims, 4 Drawing Figures

DEVICE FOR TOWING LUGGAGE

BACKGROUND OF THE INVENTION

This invention relates to a device for towing luggage and particularly to one including a retractable handle and retractable wheels attached to the luggage.

The luggage commonly used currently is provided with a wheel assembly at its bottom for convenient carrying. But this kind of luggage still has the disadvantage of having to be held all the time to prevent it from sliding away when a car or train travels at a high speed or stops suddenly. If a car or train is crowded, then it is easy to damage the wheel assembly of this type of luggage when getting into or out of a car or train. The luggage has to be placed in a flat position in order to prevent it from sliding about on its wheels, and as a result, requires more space for storage, which is a disadvantage when the car or train is crowded.

SUMMARY OF THE INVENTION

The main object of this invention is to provide a device for towing luggage which can be kept in a retracted position when not in use.

According to the present invention, a device for towing luggage comprises a pair of fixed tubes, a pair of push-pull tubes, a pair of levers and a U-shaped tube in which each of the fixed tubes is provided with two diametrically opposite first slots in its wall and each of the push-pull tubes is provided with two diametrically opposite second slots in its wall, wherein each end of the U-shaped tube is provided with a cross pin extended into the first and second slots. A pair of levers, each have one end overlapped and hinged on the middle of the U-shaped tube, and a pair of wheel units are pivoted to the other ends of the levers. The U-shaped tube slides down when one presses down the push-pull tubes, the cross pins which extend into the U-shaped and push-pull tubes slide down along their slots, and the one end of the levers which are overlapped and hinged on the middle of the U-shaped tube all slide down at the same time. An axle pin at the middle of each of the levers is fulcrumed to the wall of the luggage, allowing the other ends of the levers to move up and down. A pair of reversed L-shaped links having their upper ends respectively pivoted to the other ends of the levers and the angled part of each link pivoted to the wall of the luggage. Therefore, the wheel units can be retracted into the luggage due to the reversed L-shaped links that act as a fulcrum. Similarly, if the push-pull tubes are being pulled up, then the U-shaped tube and one end of each of the levers moves up to allow the other end of each of the levers to move down. The wheel units extended outwardly from the luggage due to the reversed L-shaped links acting as a fulcrum, saving energy in transporting the luggage.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 1:
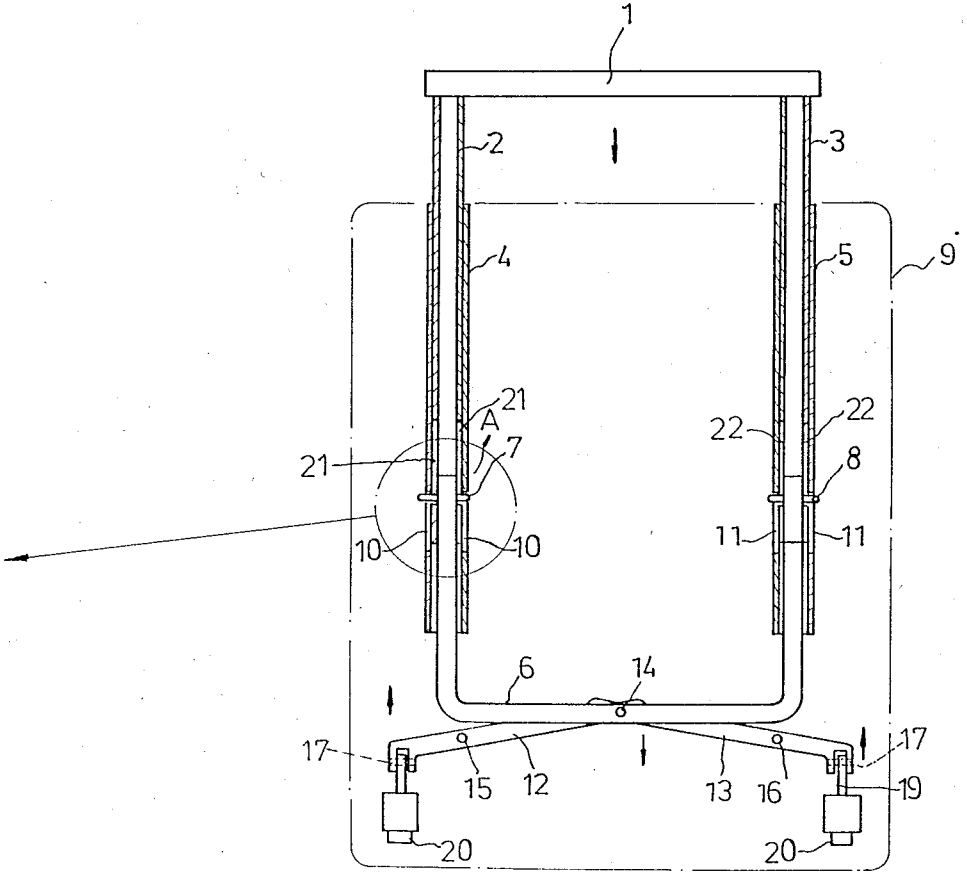
FIG. 1 is a front sectional view of a preferred embodiment of a device for towing luggage in its extended position.
Figure 4:
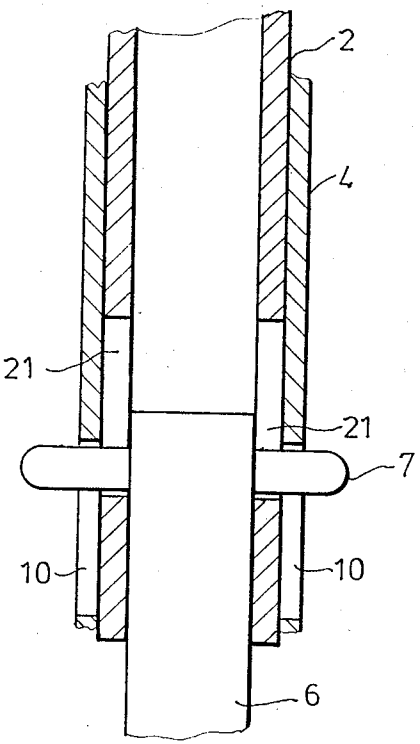
FIG. 4 presents "A" on a large scale.
Figure 3:
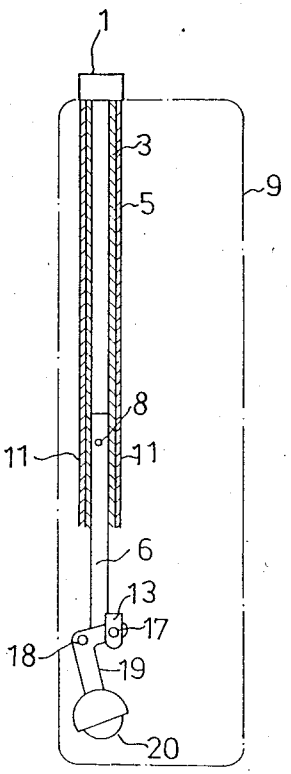
FIG. 3 is a side sectional view of a preferred embodiment of a device for towing luggage.
Figure 2:
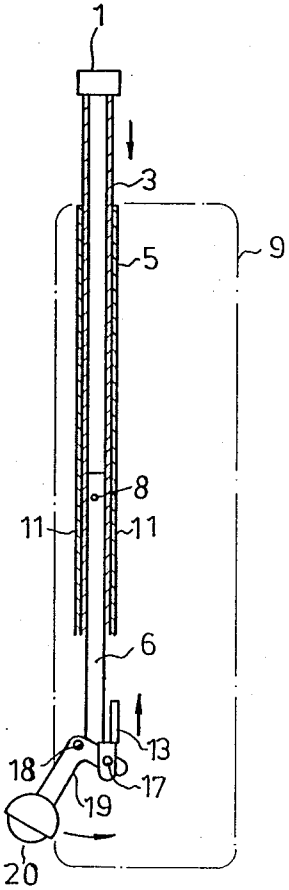
FIG. 2 is a side sectional view of a preferred embodiment of a device for towing luggage in its extended position.

Referring to FIG. 1, a pair of fixed tubes 4 and 5 are attached to a wall of the luggage 9 and are spaced apart, while a pair of push-pull tubes 2 and 3 are inserted slidably into the fixed tubes 4 and 5. A handle bar 1 is connected to the upper ends of the push-pull tubes 2 and 3; a U-shaped tube 6 has its ends connected to the lower ends of the push-pull tubes 2 and 3; the fixed tubes 4, 5 are respectively provided with diametrically opposite first slots 10 and 11 in their walls and the push-pull tubes 2, 3 are respectively provided with diametrically opposite second slots 21 and 22 in their walls, and each end of the U-shaped tube is provided with cross pins 7 and 8 which fit into the first and second slots 10, 11, 21 and 22. A pair of levers 12 and 13, one end of each being overlapped and hinged on the middle of the U-shaped tube 6 by a first pin 14, and at their middle part of the levers 12 and 13 being pivoted to the wall of the luggage 9 by a pair of first axle pins 15 and 16. A pair of reversed L-shaped links 19 have their upper ends respectively pivoted to the other end of the levers 12 and 13 by a second pin 17 and the angle parts of each reversed L-shaped link 19 are pivoted to the wall of the luggage 9 by a second axle pin 18. (See in FIG. 2.)

Referring to the drawings, when the handle bar 1 is pressed down, the push-pull tubes 2 and 3 are pushed into the wall of the luggage 9, and the cross pins 7 and 8 slide down along the first slots 10 and 11 of the fixed tubes 4 and 5. The U-shaped tube 6 also slides down at the same time and this allows the one end of each of the levers 12 and 13 which are hinged on the middle of the U-shaped tube 6 to slide down. Then, the other ends of the levers 12 and 13 move up, retracting the wheel units 20, due to the reversed L-shaped links 19. Similarly when pulling up the handle bar 1, the cross pins 7 and 8 move up along the second slots 20 and 21 of the push-pull tubes 2 and 3. The U-shaped tube 6 and one end of each of the levers 12 and 13 also moves up and the other ends of the levers 12 and 13 move down to extend the wheel units 20 outwardly from the luggage due to the fact that the reversed L-shaped links act as a fulcrum.

With the invention thus explained, it is apparent that the additional improvements provide obvious advantages for practical use.

What I claim is:

1. A device for towing luggage comprising:

a pair of fixed tubes spacedly attached to a wall of the luggage;

a pair of push-pull tubes each of which is inserted slidably into one of said fixed tubes;

a handle bar which is connected to the upper ends of said push-pull tubes;

a U-shaped tube having its ends connected to the lower ends of said push-pull tubes;

a pair of levers one end of each being hinged on the middle of said U-shaped tube, and the middle parts of said levers being pivoted to the wall of said luggage;

a pair of reversed L-shaped links having their upper ends respectively pivoted to the other ends of said levers and the angled part of each link pivoted to the wall of said luggage; and a pair of wheel units mounted on the lower ends of said links.

2. A device for towing luggage as in claim 1, in which each of said fixed tubes is provided with two diamatrically opposite first slots in its wall and each of said push-pull tubes is provided with two diametrically opposite second slots in its wall, wherein each end of said U-shaped tube is provided with a cross pin extended into said first and second slots.

* * * * *